United States Patent [19]

Wittchow et al.

[11] Patent Number: 5,056,468

[45] Date of Patent: Oct. 15, 1991

[54] STEAM GENERATOR

[75] Inventors: Eberhard Wittchow, Erlangen; Joachim Franke, Altdorf; Wolfgang Vollmer, Erlangen, all of Fed. Rep. of Germany

[73] Assignee: Siemens Aktiengesellschaft, Munich, Fed. Rep. of Germany

[21] Appl. No.: 648,904

[22] Filed: Jan. 31, 1991

[30] Foreign Application Priority Data

Jan. 31, 1990 [EP] European Pat. Off. ..... 90101940.6

[51] Int. Cl.[5] ..... F22D 5/26

[52] U.S. Cl. ..... 122/451.5; 122/406.4; 122/406.5

[58] Field of Search ..... 122/406.1, 406.4, 406.5, 122/451 R, 451 S, 451.1, 451.2

[56] References Cited

U.S. PATENT DOCUMENTS

| | | | |
|---|---|---|---|
| 3,213,835 | 10/1965 | Egglestone . | |
| 3,297,004 | 1/1967 | Midtlyng . | |
| 4,290,389 | 9/1981 | Palchik | 122/406.4 |
| 4,294,200 | 10/1981 | Gorzegno | 122/406.4 |
| 4,457,266 | 7/1984 | Laspisa | 122/451.1 |
| 4,829,831 | 5/1989 | Kefer et al. . | |
| 4,841,918 | 6/1989 | Fukayama et al. | 122/406.5 |
| 4,869,210 | 9/1989 | Wittchow | 122/451 S |

FOREIGN PATENT DOCUMENTS

| | | |
|---|---|---|
| 641884 | 6/1964 | Belgium . |
| 0025975 | 4/1981 | European Pat. Off. . |
| 3242968 | 1/1984 | Fed. Rep. of Germany . |
| 6910208 | 1/1971 | Netherlands . |

OTHER PUBLICATIONS

G. Klefenz: "Die Regelung von Dampfkraftwerken", 1985, Bibliografisches Institut, Mannheim: p. 109, line 1–p. 129, line 8, Figs. 73 and 83.1.

R. Dolezal: "Dampferzeugung", 2/1985, pp. 7, 8 and 262.

*Primary Examiner*—Edward G. Favors

*Attorney, Agent, or Firm*—Herbert L. Lerner; Laurence A. Greenberg

[57] ABSTRACT

A steam generator includes a gas flue having burners for fossil fuel, a gas-tight tube wall with tubes, inlet and outlet headers connected to the tubes, the outlet header being at a higher level than the inlet header, and a down pipe outside the tube wall connecting the outlet to the inlet header. A steam line is connected to the outlet header and at least one heating surface is connected downstream of the outlet header in the steam line. A feedwater line is connected to the gas flue and an economizer is connected upstream of the gas flue in the feedwater line. A regulating device for influencing feedwater flow in the feedwater line detects at least one of: the steam enthalpy in the heating surface or the steam line downstream of the heating surface, the steam temperature in the heating surface or the steam line downstream of the heating surface, the thermal output transfer to the tubes, a ratio of feedwater flow in the feedwater line to steam flow in the steam line, a ratio of injection water flow into an injection cooler connected in the steam line to feedwater flow in the feedwater line, and residual moisture of steam in the steam line.

19 Claims, 10 Drawing Sheets

STEAM GENERATOR

The invention relates to a steam generator.

FIG. 1.4, page 7 and FIG. 32.7, page 262 of the book entitled "Dampferzeugung" [steam generation] by Dolezal, published by Springer-Verlag in 1985, discloses a steam generator that is a natural circulation steam generator and is also known as a drum boiler. The outlet header for the tubes of the gas-tight tube wall in that device is the drum of the natural circulation steam generator. Downstream of the drum on the outlet side are superheaters in the form of heating surfaces. A regulating device has a motor-driven regulating valve that is located in a feedwater line leading from an economizer to the drum. The regulating device also has a level meter for the level of water in the drum acting as a controlled variable pickup, so that the regulating device detects the water level in the drum as the controlled variable. In the regulating device, the flow cross section of the regulating valve in the feedwater line becomes smaller whenever a predetermined water level in the drum is exceeded. The flow cross section becomes larger if the water level drops below a predetermined level in the drum. There is no provision for attaining critical steam pressure in the drum, and that could be prevented, for example, by means of an overpressure valve mounted on the drum.

As a result, a water level always develops in the drum and the final evaporation point of the water is always located in the drum. The evaporation takes place exclusively in the tubes of the gas-tight tube wall into which water is fed from the drum through the down pipe by natural circulation. It is solely superheating of the steam that emerges from the drum. This superheating takes place in the heating surfaces downstream of the drum on the outlet side.

In such a natural circulation steam generator, when there are load changes in the partial-load range, major variations in the steam temperature at the steam outlet of the heating surfaces occur. As these load changes become faster and more pronounced, the changes in the steam temperature also become faster and larger. Headers that are connected to the steam outlet of the heating surfaces are therefore subjected to major thermal strains. Since they are exposed not only to high steam temperatures but also to high steam pressure, they must be constructed with especially thick walls if they are to have adequate strength. The thermal strains easily cause damage to the headers, because the walls are so thick.

It is accordingly an object of the invention to provide a steam generator, which overcomes the hereinaforementioned disadvantages of the heretofore-known devices of this general type and which avoids changes, in particular fast and pronounced changes, in the steam temperature of the steam leaving the heating surfaces of the steam generator.

With the foregoing and other objects in view there is provided, in accordance with the invention, a steam generator, comprising a gas flue having burners for fossil fuel, a gas-tight tube wall with tubes, an inlet header and an outlet header connected to the tubes, the outlet header being at a higher local level than the inlet header, and a down pipe outside the tube wall (or with respect to circulation) connecting the outlet header to the inlet header so as to permit flowing of a fluid between said outlet header and said inlet header (with respect to circulation); a steam line connected to the outlet header, at least one heating surface connected downstream of the outlet header in the steam line so as to permit flowing of a fluid from said outlet header to said heating surface; a feedwater line connected to the gas flue, an economizer connected upstream of the gas flue in the feedwater line so as to permit flowing of a fluid from said economizer to said gas flue; and a regulating device for influencing or varying feedwater flow in the feedwater line, the regulating device detecting at least one of the following controlled variables:

(a) steam enthalpy in the heating surface or the steam line downstream of the heating surface, (b) steam temperature in the heating surface or the steam line downstream of the heating surface, (c) thermal output transfer to the tubes of the gas-tight tube wall, (d) a ratio of feedwater flow in the feedwater line to steam flow in the steam line, (e) a ratio of injection water flow into an injection cooler connected in the steam line to feedwater flow in the feedwater line, and (f) residual moisture of steam in the steam line.

The feedwater line may be connected to the outlet header or to the down pipe. A topping header may be disposed at a lower local level than the inlet header, with the feedwater line being connected to the topping header, and the gas-tight tube wall may have additional tubes extending from the topping header, wherein each of the additional tubes merge with a respective one of the tubes of the gas-tight tube wall being connected to the inlet header.

In this steam generator, instead of the known water level regulation on the drum, a regulation to at least one of the variables (a) through (f) is accordingly performed.

At subcritical pressure, load changes in this steam generator automatically lead to changes in the length of the heating surface available for superheating the steam generator, since the final liquid-vapor phase transition point of the water is no longer fixed by the water level in the outlet header, and the temperature of the steam leaving the heating surfaces remains constant despite load changes.

A regulating device that detects one of the controlled variables (a) through (e) remains functional even if the pressure in the steam generator is critical or supercritical, in which case a distinction between the physical state of water and steam clearly no longer exists.

Operation of the steam generator at critical or supercritical pressure is advantageous for achieving high thermal efficiency of a power plant of which the steam generator is a part. With this high thermal efficiency, reduced fuel consumption and thus low toxic emissions and in particular carbon dioxide emissions of the power plant, are attained.

The down pipe of the steam generator enables circulation, if necessary even forced circulation through the tubes of the gas-tight tube wall to occur, regardless of whether subcritical, critical or supercritical pressure prevails in the steam generator. This circulation brings about a high flow rate in the tubes of the gas-tight tube wall and thus good cooling of these tubes, even if only a relatively small flow of feedwater is supplied to the steam generator. The steam generator can therefore be constructed for relatively low steam outputs, which is an advantage for the sake of non-polluting heating power plants, for example.

In accordance with another feature of the invention, the regulating device detects the variable c and at least one of the variables a, b, d, e and f as controlled variables. This embodiment of the steam generator effects fast-responding and particularly accurate regulation of the feedwater flow in the feedwater line.

In accordance with a further feature of the invention, there is provided a jet pump, the feedwater line having a point of discharge into the down pipe in the form of a nozzle of the jet pump, the nozzle having a fuel connection connected to the economizer, the down pipe forming a diffuser of the jet pump at the point of discharge with a pressure neck connected to the header, and the jet pump having a head with an intake neck connected to the outlet header. The tubes of the gas-tight tube wall of the steam generator may also be vertically disposed, so that the steam generator can be manufactured at particularly favorable cost. The circulation through these vertically disposed tubes of the tube wall may even be natural circulation, because of the optimally low flow resistance in the tubes.

In accordance with an added feature of the invention, the inside cross section of the down pipe is larger than the inside cross section of each of the tubes of the gas-tight tube wall.

In accordance with an additional feature of the invention, the tubes of the gas-tight tube wall have helically disposed internal ribs.

In accordance with yet another feature of the invention, there is provided a final header disposed at a higher level than the outlet header, and additional tubes of the tube wall being connected to the outlet header and leading to the final header.

In accordance with yet a further feature of the invention, the tubes of the gas-tight tube wall have a larger inside cross section than the additional tubes leading from the outlet header to the final header.

In accordance with yet an added feature of the invention, the tubes of the gas-tight tube wall have a larger inside cross section than the additional tubes originating at the topping header.

In accordance with yet an additional feature of the invention, there is provided a shaped element disposed in the gas-tight tube wall for securing one of the tubes of the gas-tight tube wall discharging into the outlet header to one of the additional tubes.

In accordance with again another feature of the invention, the shaped element has a flow opening formed therein from the one tube to the one additional tube of the gas-tight tube wall, the flow opening having a smaller flow cross section than the inside cross section of the one tube.

In accordance with again a further feature of the invention, the outlet header has a hollow cylindrical wall into which one of the tubes of the gas-tight tube wall discharges at least approximately at a tangent and/or from which one of the additional tubes of the gas-tight tube wall extends radially outwardly.

With these advantageous further embodiments, high circulation through the down pipe and tubes of the gas-tight tube wall is produced even at high pressure, in particular at supercritical pressure in the steam generator.

In accordance with again an added feature of the invention, there is provided a water separator connected downstream of the at least one heating surface for separating water. This facilitates startup of the steam generator.

In accordance with again an additional feature of the invention, there are provided superimposed and/or separating controls.

In accordance with a concomitant feature of the invention, there is provided a controller acting on a flow of feedwater in the feedwater line, and a superimposed controller feeding an output to the controller as a set-point value, one of the controlled variables a-f being supplied to the superimposed controller as an actual value.

Other features which are considered as characteristic for the invention are set forth in the appended claims.

Although the invention is illustrated and described herein as embodied in a steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 8:
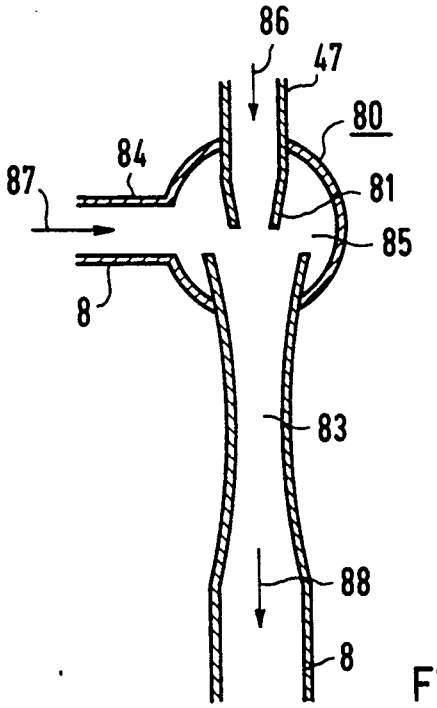
Figure 7:
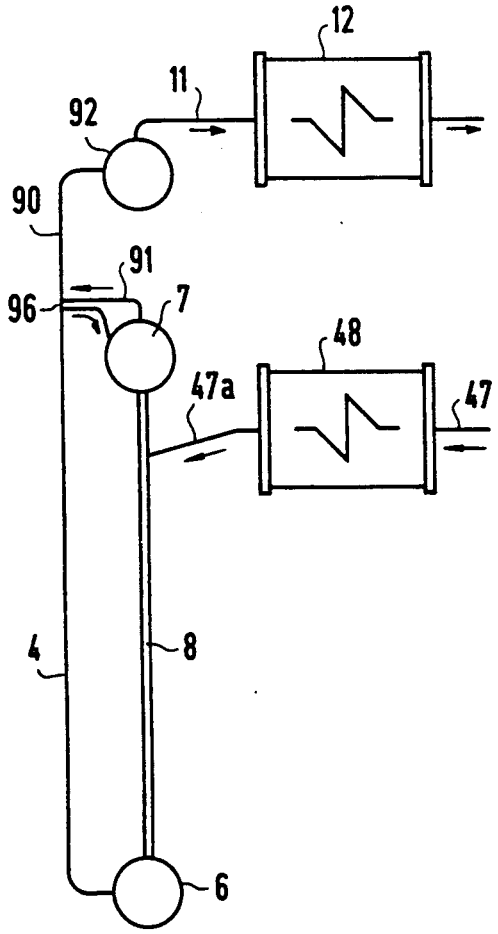
Figure 9:
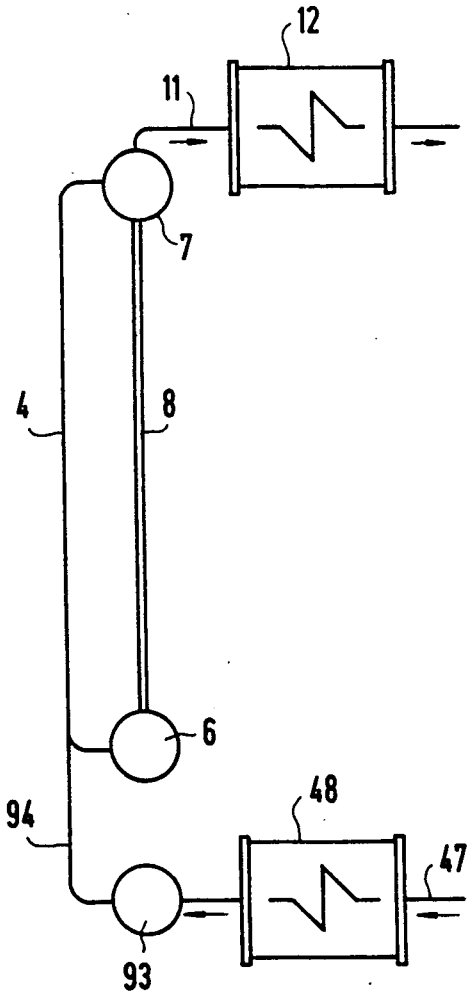
Figure 12:
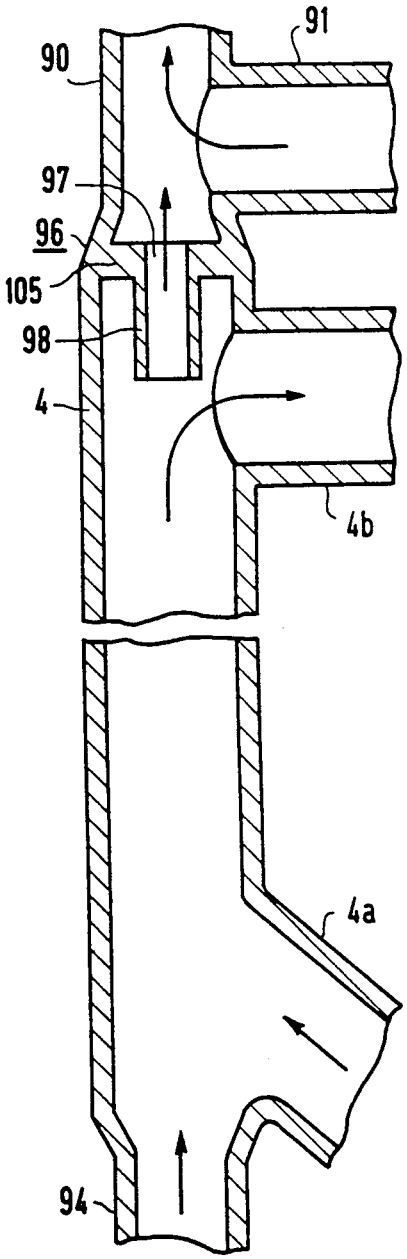
Figure 13:
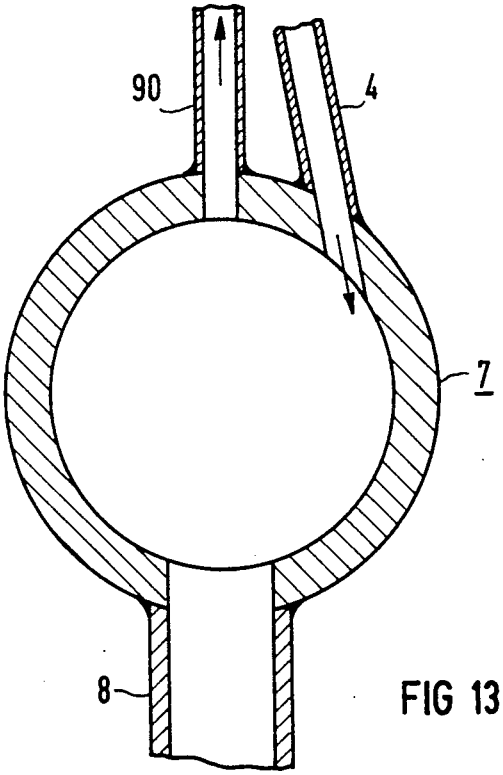
Figure 15:
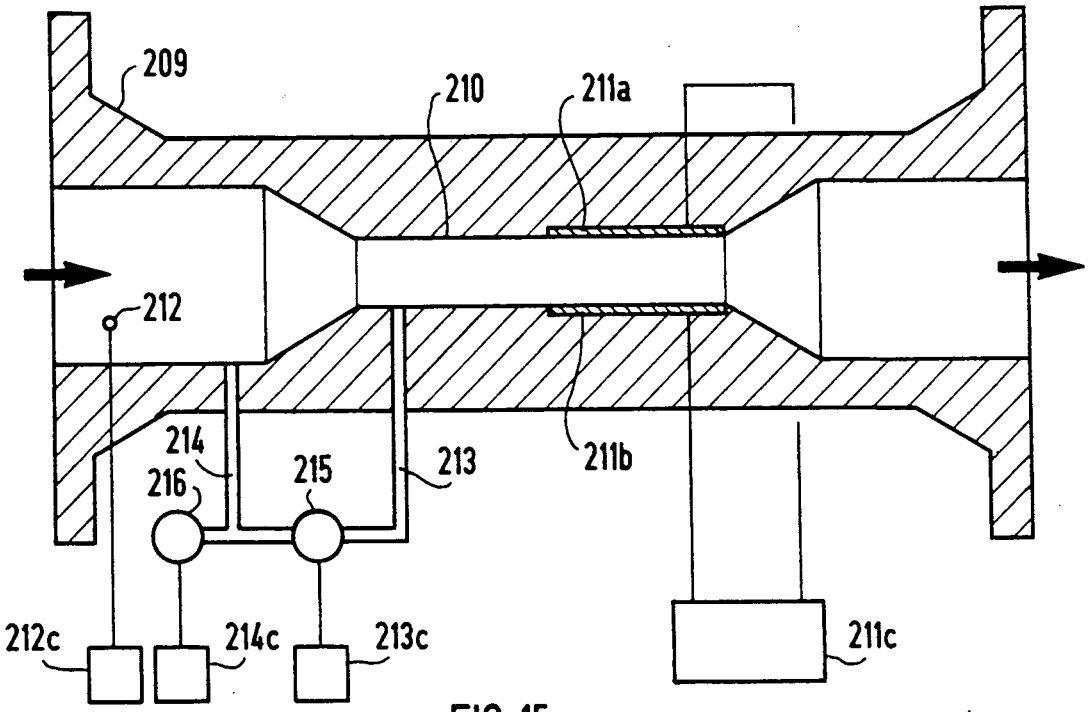
Figure 14:
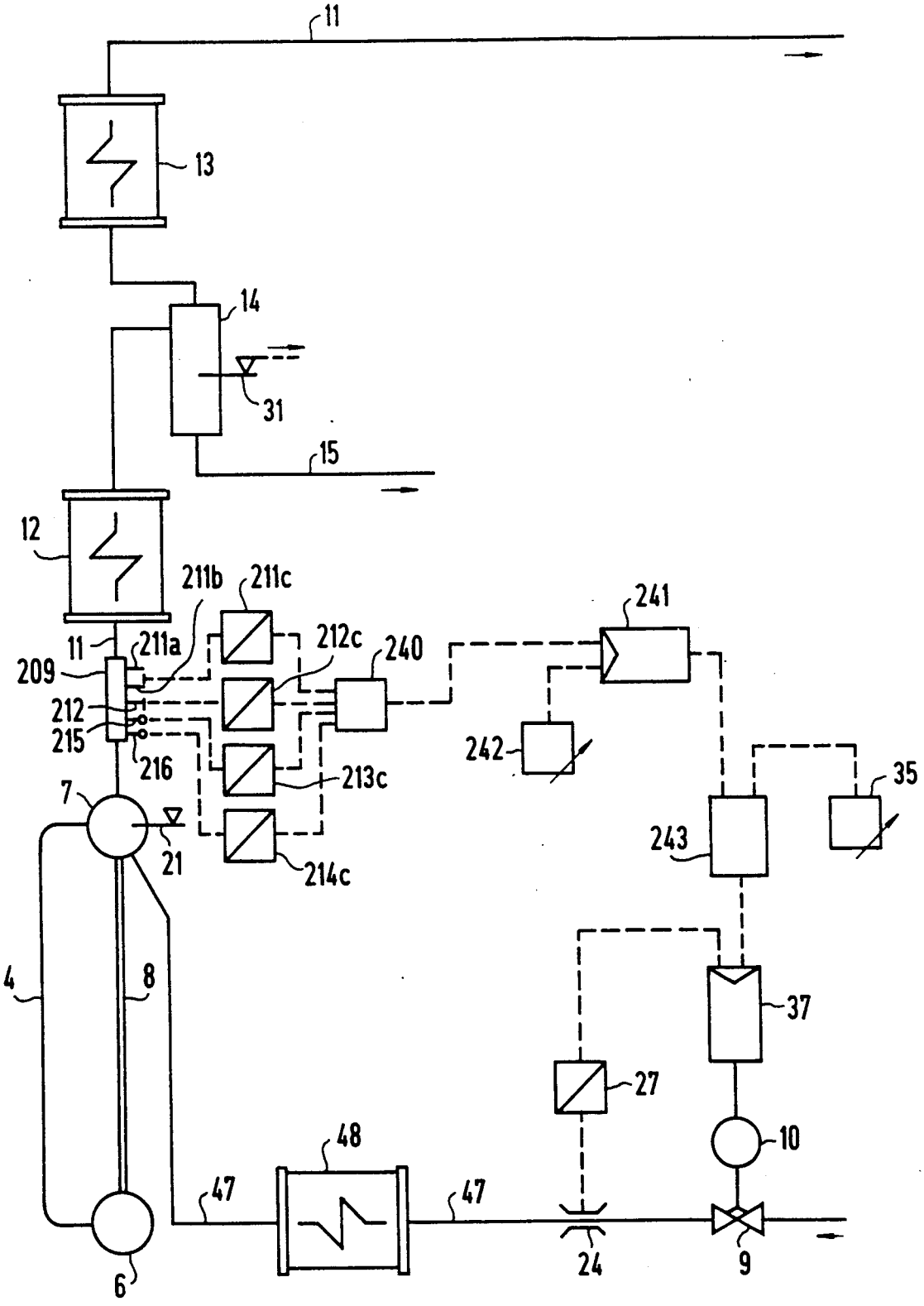

FIGS. 7 and 9 are simplified schematic circuit diagrams and FIGS. 8 and 10–13 are fragmentary, diagrammatic, sectional views, showing further advantageous features in steam generators according to the invention; and FIG. 15 is a fragmentary, diagrammatic, longitudinal-sectional view showing measurement value pickups for determining the residual moisture in the steam in the steam line of the steam generator of FIG. 14.

Figure 1:
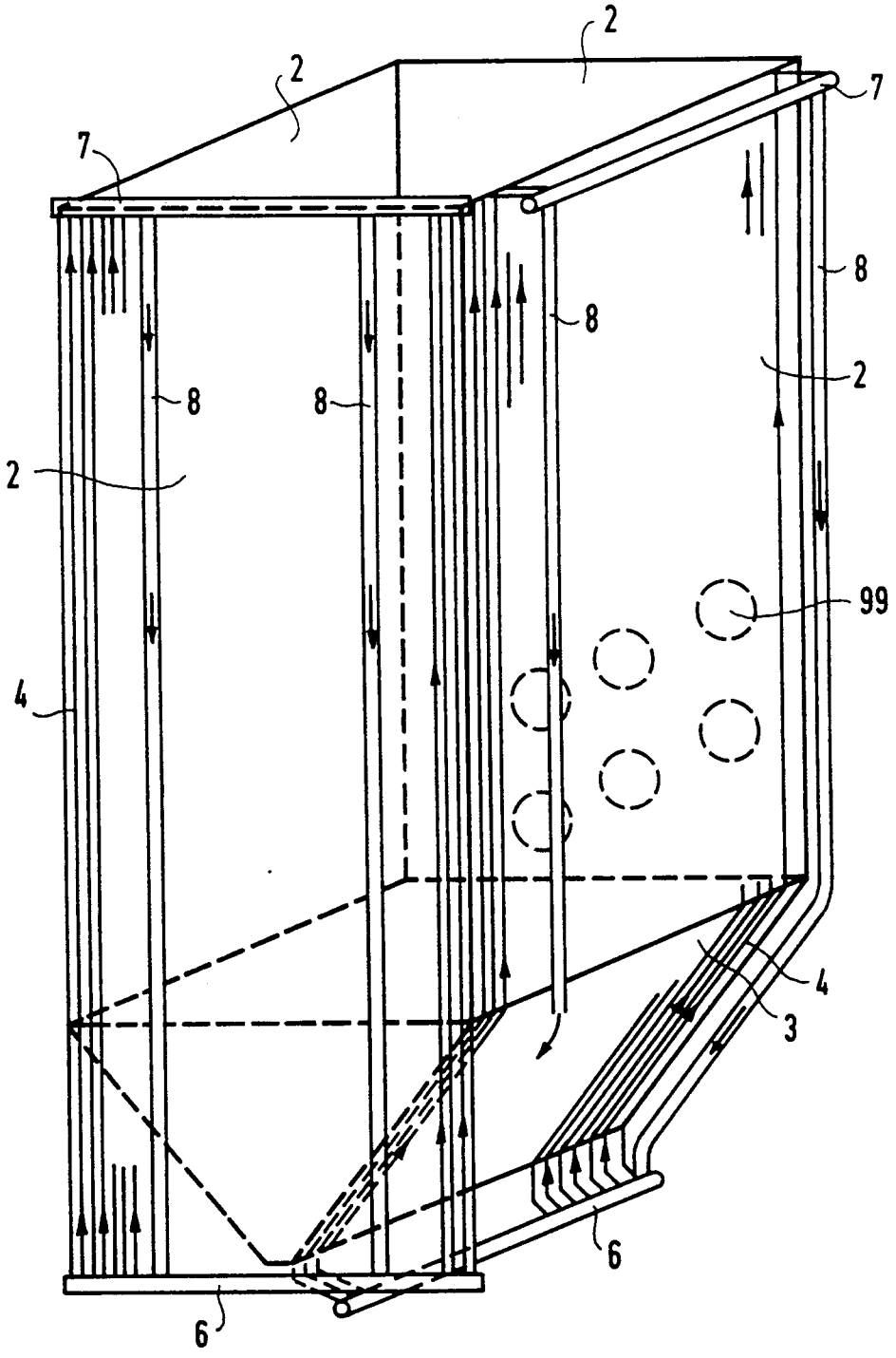
FIG. 1 is a highly diagrammatic, perspective view showing the gas flue of a steam generator according to the invention.

Referring now to the figures of the drawing in detail and first, particularly, to FIG. 1 thereof, there is seen a vertical gas flue with a rectangular cross section, that is formed of a gas-tight tube wall 2 which changes into a bottom 3 in the form of a funnel at the lower end of the gas flue. Tubes 4 of the tube wall 2 which are disposed in longitudinal sectional planes of the gas flue extend obliquely in sides of the bottom 3 but otherwise the tubes 4 are vertically disposed. Furthermore, all of the tubes 4 of the tube wall 2 and of the bottom 3 are welded to one another in gas-tight fashion at the long sides thereof. The bottom 3 forms a non-illustrated opening for the removal of ashes.

Six burners for fossil fuels are each mounted in a respective opening 99 formed in the lower part of the tube wall 2 of the vertical gas flue. The tubes 4 of the tube wall 2 are curved at such openings and extend on the outside of the vertical gas flue. Similar openings may also be formed for air nozzles, flue gas nozzles, soot blowers and so forth.

The tubes 4 of the tube wall 2 have lower ends in the form of inlet ends that are connected to inlet headers 6 and upper ends in the form of outlet ends that are connected to outlet headers 7. The outlet headers 7 and inlet headers 6 are located outside the gas flue. The outlet headers 7 are located at a higher level than the inlet headers 6. Each outlet header 7 also communicates through vertical down pipes 8, that are likewise located outside the gas flue, with the inlet header 6 to which the tubes 4 of the tube wall that discharge into this outlet header 7 are also connected.

Figure 2:
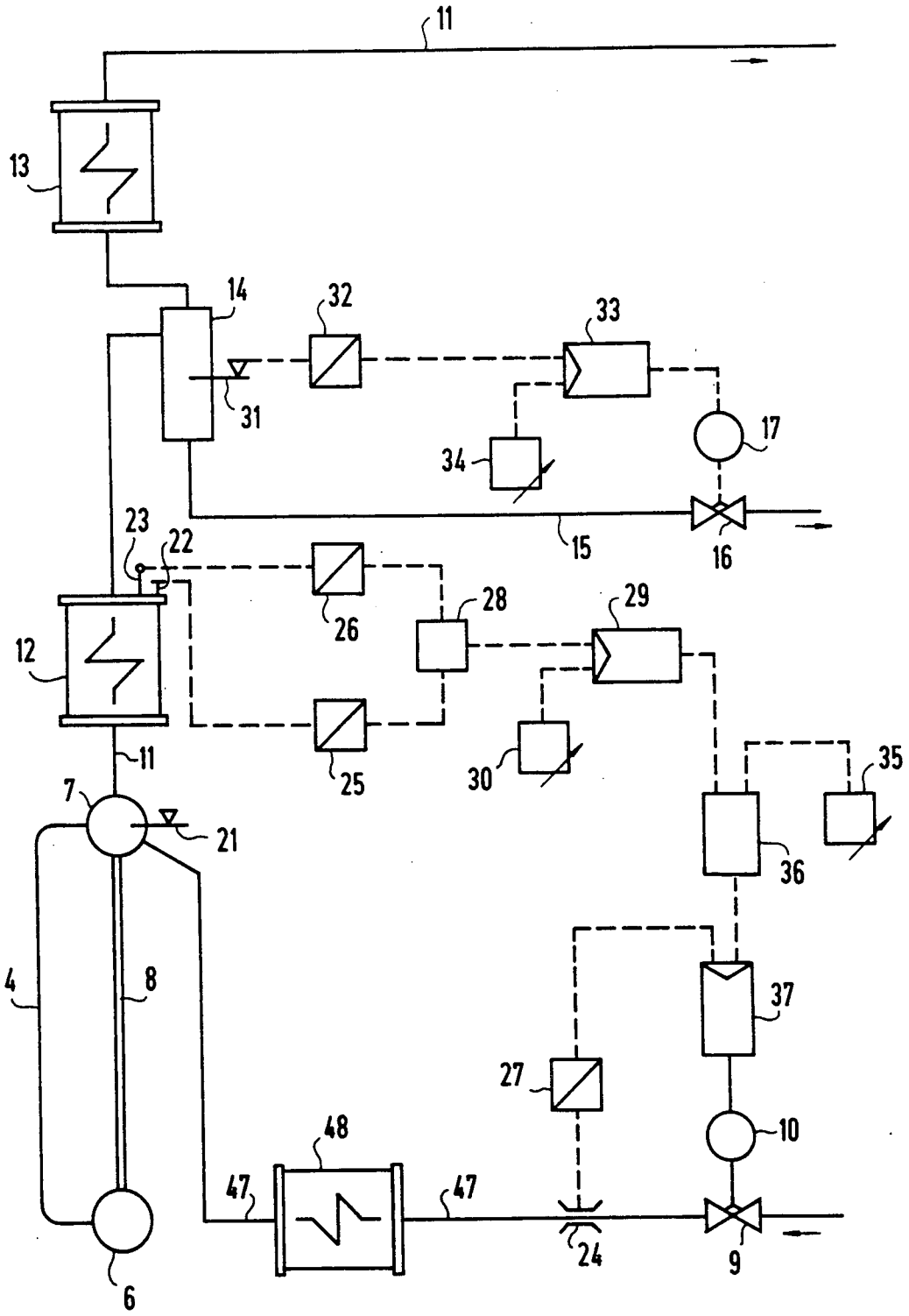
FIGS. 2, 3, 5, 6 and 14 are simplified schematic circuit diagrams of the steam generator according to the invention having the gas flue of FIG. 1 and an associated regulating device.

As FIG. 2 shows, a feedwater line 47, which includes an economizer (feedwater preheater) 48, leads into the outlet header 7. This economizer 48 is constructed of an inlet header, an outlet header, and heating surface tubes that interconnect these two headers. These tubes, which are not shown in FIG. 1, are disposed as a heating surface inside a gas flue that adjoins the upper end of the gas flue of FIG. 1. A regulating valve 9 with a motor drive 10 is located in the feedwater line 47 upstream of the economizer 48.

A steam line 11 begins at the upper end of the outlet header 7 and includes two series-connected heating surfaces 12 and 13 and a water separator 14 connected between the two heating surfaces 12 and 13. The outlet header 7, the steam line 11, the heating surfaces 12 and 13 and the water separator 14 thus communicate and are connected in series. The heating surfaces 12 and 13, which are not shown in FIG. 1, have heating surface tubes with inlet and outlet headers and are disposed inside the gas flue that adjoins the upper end of the gas flue of FIG. 1.

A discharge line 15, which includes a discharge regulating valve 16 having a motor drive 17, leads from the lower part of the water separator 14 to a container or to a pump, neither of which is shown in FIG. 2.

The outlet header 7 is provided with a level meter 21 (such as a float), for measuring the water level in the outlet header 7.

The heating surface 12 that is immediately downstream of the outlet header 7 in the steam line 11, has a device 22 (such as a thermocouple) at its outlet end, which measures either the steam temperature at this outlet end or the temperature of the material at this outlet end which corresponds to the steam temperature. This outlet end of the heating surface 12 is also provided with a device 23 (for instance a spring pressure meter used as a pressure transducer) for measuring the steam pressure at this outlet end.

Disposed in the feedwater line 47 is a feedwater flow rate meter 24 (for measuring the quantity of feedwater per unit of time), which is connected upstream of the economizer 48 and downstream of the regulating valve 9.

The regulating valve 9 with its motor drive 10, the device 22 for measuring the steam temperature or a material temperature corresponding to the steam temperature, the device 23 for measuring the steam pressure and the feedwater flow rate meter 24, all belong to a regulating device of the steam generator which is used for varying the flow of feedwater into the steam generator. This regulating device also has a measurement transducer (signal converter) 25 for the device 22 for measuring the steam temperature or a material temperature corresponding to the steam temperature; a measurement transducer 26 for the device 23 for measuring the steam pressure; and a measurement transducer 27 for the feedwater flow rate meter 24.

The measurement transducers 25 and 26 each emit an output signal to a device 28 for determining the steam enthalpy from the variables of steam temperature and steam pressure that are measured by the devices 22 and 23. The device 28 has a computer. The device 28 for determining the steam enthalpy in turn emits a signal at its output to a controller 29, which is provided with a set-point adjuster 30.

The output signal of the controller 29 and the output signal of a set-point adjuster 35 are carried to a maximum value selection unit 36, the output signal of which is carried to a controller 37. The output signal of the measurement transducer 27 is also carried to the controller 37.

The water separator 14 is provided with a level meter 31 for measuring the water level in the water separator 14. An output signal is carried from a measurement transducer 32 of the level meter 31 to a controller 33, which is provided with a set-point adjuster 34 and acts upon the motor drive 17 to the discharge regulating valve 16.

Upon steam generator startup, before the burners in the openings 99 of FIG. 1 are fired, the feedwater line 47 along with the economizer 48, the inlet header 6, the tubes 4 of the tube wall 2 and the down pipes 8, are all filled with feedwater until such time as a water level is measured with the level meter 21 in the outlet header 7. As a result, natural circulation can begin immediately after firing of the burners and can reliably cool the severely heated tubes 4 of the tube wall 2. At the moment that the first burner is fired, the controller 29 is still off, and therefore it has no effective output signal. The set-point adjuster 35 specifies a particular set-point value for the feedwater flow measured with the feedwater flow rate meter 24, which acts upon the controller 37 through the maximum value selection unit 36 and adjusts the feedwater flow to the outlet header 7 as specified by the set-point adjuster 35 by means of the regulating valve 9 through the motor drive 10.

Once one or more of the burners in the openings 99 have been fired, steam production begins in the tube 4 of the tube wall 2. As a result, a natural circulation begins in the tubes 4 of the tube wall 2 and in the down pipes 8. The steam produced in the tubes 4 of the tube wall 2 forces water out of the tubes 4. This expelled water causes the water level beyond the outlet header 7 to rise until such time as the water, along with the steam produced in the tubes 4, reaches the steam line 11 and the heating surface 12, while proceeding as far as the water separator 14. In the water separator 14, the water is separated from the steam. The water level in the water separator 14 therefore rises, until it exceeds a set-point value specified by the set-point adjuster 34. As a result, the output signal of the controller 33 changes and affects the discharge regulating valve 16 through its motor drive 17, in such a way that the flow cross section of the discharge regulating valve 16 increases with an increasing water level in the water separator 14, while the flow cross section of the discharge regulating valve 16 decreases with a decreasing water level, so that the water level specified by the set-point adjuster 34 is maintained within certain limits. As a result, relatively cold water, which is expelled from the tubes 4 of the tube wall 2 by steam production in these tubes and which leaves the outlet header 7 along with the steam being produced, is prevented from reaching the already severely heated heating surface 13 and cooling it down abruptly.

With increasing firing thermal output, which is supplied by the burners to the steam generator, the water flow entering the water separator 14 becomes less and less, until it finally dwindles to nothing. The feedwater supplied through the feedwater line 47 is then entirely evaporated, both in the tubes 4 in the tube wall 2 and in the heating surface 12. The water level in the water separator 14 drops during this process, until the discharge regulating valve 16 has closed.

During this startup phase, the controller 29 is turned on manually, for instance, so that it furnishes an output signal carried to the maximum value selection unit 36. However, since the steam enthalpy determined by the device 28 is even less than the steam enthalpy specified by the set-point adjuster 30, the output signal of the controller 29 is quite low to be used as a set-point value for the feedwater flow that is measured with the feedwater flow rate meter 24. The maximum value selection unit 36 therefore continues to select the output signal of the set-point adjuster 35, which is higher than the output signal of the controller 9, for varying the supply of feedwater. As soon as the discharge regulating valve 16 has closed and the firing thermal output of the burners in the openings 99 in the tube wall 2 is increased further at a predetermined, constant supply of feedwater through the feedwater line 47, the steam temperature measured with the device 22 and the steam pressure measured with the device 23 and thus the steam enthalpy determined with the device 28, also increase. The output signal of the controller 29 is guided in such a way that at the instant when the output signal of the device 28 with which the steam enthalpy is determined becomes higher than the output signal specified by the set-point adjuster 30, the maximum value selection unit 36 switches over smoothly to the output signal of the controller 29 as a set-point value for the controller 37. As a result, regulation of the feedwater supply through the feedwater line 47 to a feedwater flow determined by the set-point adjuster 37 is switched off, and the regulation of this feedwater supply to a steam enthalpy in the steam line 11 that is predetermined by the set-point adjuster 30 is switched on.

After the end of this startup process for the steam generator, the steam pressure in the steam generator is usually still below the critical pressure. The steam pressure is therefore raised subsequently to the extent required by the power plant steam turbine supplied by the steam generator.

Finally, the steam generator is operated at critical or supercritical pressure. Nevertheless, the natural circulation through the tubes 4 of the tube wall 2 and through the down pipes 8 is maintained, and the supply of feedwater through the feedwater line 47 can be regulated to a steam enthalpy in the steam line 11 predetermined by the set-point adjuster 30. Due to the natural circulation in the tubes 4 and the down pipes 8, the steam generator can even be supplied with a relatively small feedwater flow, without endangering cooling of the tubes 4 of the tube wall 2.

While regulation of the feedwater supply through the feedwater line 14 to a predetermined steam enthalpy in accordance with FIG. 2 is advantageous when the steam generator is operated with load-proportional steam pressure (which is known as sliding pressure operation), if the steam generator is operated at constant steam pressure (fixed pressure operation) it may, for instance, already be sufficient if the output signal of the measurement transducer 25 of FIG. 2, with which the device 22 for measuring the steam temperature is associated, is connected directly to the controller 29, whereas the device 23 for measuring the steam pressure with the measuring transducer 26 and the device 28 for determining the steam enthalpy are omitted. In that case, a set-point value of the steam temperature at the outlet end of the heating surface 12 is specified with the set-point adjuster 30.

Figure 3:
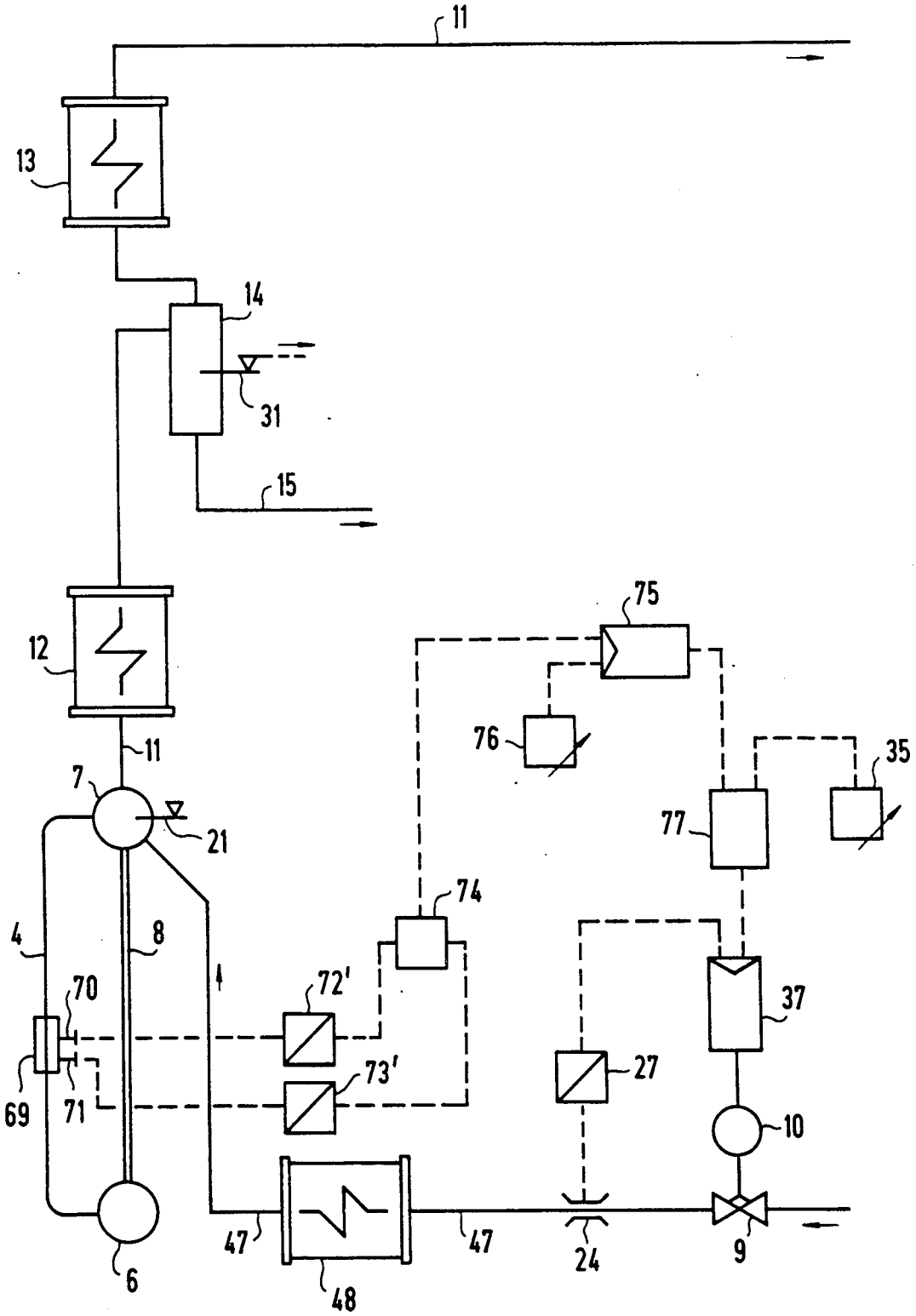

In FIG. 3, identical elements are identified by the same reference numerals as in FIG. 2. A regulating device that is constructed identically to that of FIG. 2 is associated with the water separator 14. The steam generator of FIG. 3 differs from the steam generator of FIG. 2 substantially due to the fact that instead of the devices 22 and 23 for measuring the steam temperature and steam pressure at the outlet end of the heating surface 12, a device 69 for measuring tube wall temperatures on a tube 4 of a tube wall 2 is provided on that tube.

Figure 4:
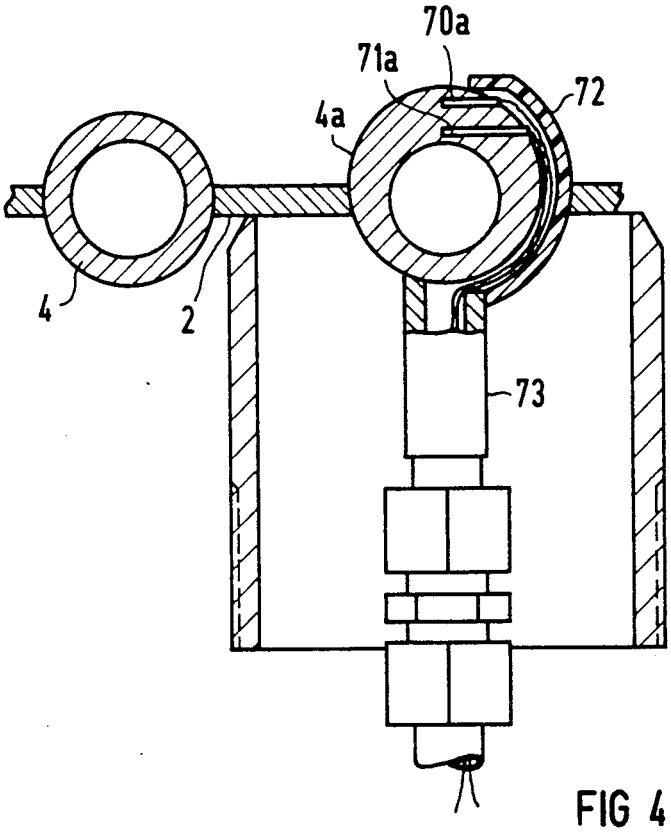
FIG. 4 is a fragmentary, diagrammatic, cross-sectional view of a measurement variable pickup for determining the thermal output transferred to a gas-tight tube wall of the steam generator of FIG. 3.

As FIG. 3 shows, this device 69 essentially has two thermocouples 70 and 71. The applicable tube 2 is provided with a tube segment 4*a* which is welded into the tube wall 2 as shown in the fragmentary cross section of FIG. 4. The tube segment 4*a* is eccentrically thickened toward the interior of the gas flue. The eccentrically thickened tube segment 4*a* is provided in the interior of the gas flue with two transverse bores 70*a* and 71*a*, which are parallel to one another and are radially spaced apart from one another. The thermocouples 70 and 71 are each disposed in a respective one of these transverse bores 70*a* and 71*a*. The connecting wires of these two thermocouples 70 and 71 are covered by a channel profile 72 that is also welded into the tube wall 2 and they are carried to the outside of the tube wall 2 in a protective tube 73 located there.

Measuring transducers 72' and 73' of FIG. 3 belong to the thermocouples 70 and 71 for measuring the tube wall temperatures at two different locations of the eccentrically thickened tube segment 4*a*. A respective output signal is carried from each of these measuring transducers 72 and 73 to to an apparatus 74 having a computer. The apparatus 74 determines the thermal output transferred to the evaporating water from the temperatures of the eccentrically thickened tube segment 4*a* measured with the thermocouples 70 and 71 and from other variables such as the wall thickness and the temperature lag of this tube segment 4*a*. A plurality of such devices 69 are advantageously mounted on the tube wall 2, in order to measure the thermal output transferred to the evaporating water at a plurality of tubes 4 and at various points of the tube wall 2. The accuracy of the measurements can be increased by averaging the variables being measured.

The thermal output thus ascertained is also multiplied in the apparatus 74 by the surface area of the tube wall 2 on the inside of the gas flue, so that the output signal from the apparatus 74 is proportional to the thermal output transferred to the entire tube wall 2. The output signal from the apparatus 74 for determining the thermal output is carried to a controller 75, which is provided with a set-point adjuster 76.

The output signals of the controller 75 and of the set-point adjuster 35 are carried to a maximum value selection unit 77, the output signal of which is in turn carried to the controller 37. As in FIG. 2, the output signal of the measuring transducer 27 associated with the feedwater flow rate meter 24 is present at this controller 37.

The mode of operation of the controller 75, the set-point adjuster 76, the maximum value selection unit 77 and the set-point value adjuster 35 of FIG. 3 is equivalent to the mode of operation of the controller 29, the set-point adjuster 30, the maximum value selection unit 36 and the set-point adjuster 35 of the steam generator of FIG. 2.

An advantage of the steam generator of FIG. 3 is that the regulating device for varying the supply of feedwater can react very quickly to changes in the thermal output that is transferred to the water evaporating in the tubes 4 of the tube wall 2. As a result, the effects of changes in the transferred thermal output upon the steam temperature in the heating surfaces 12 and 13 remain extraordinarily slight.

Figure 5:
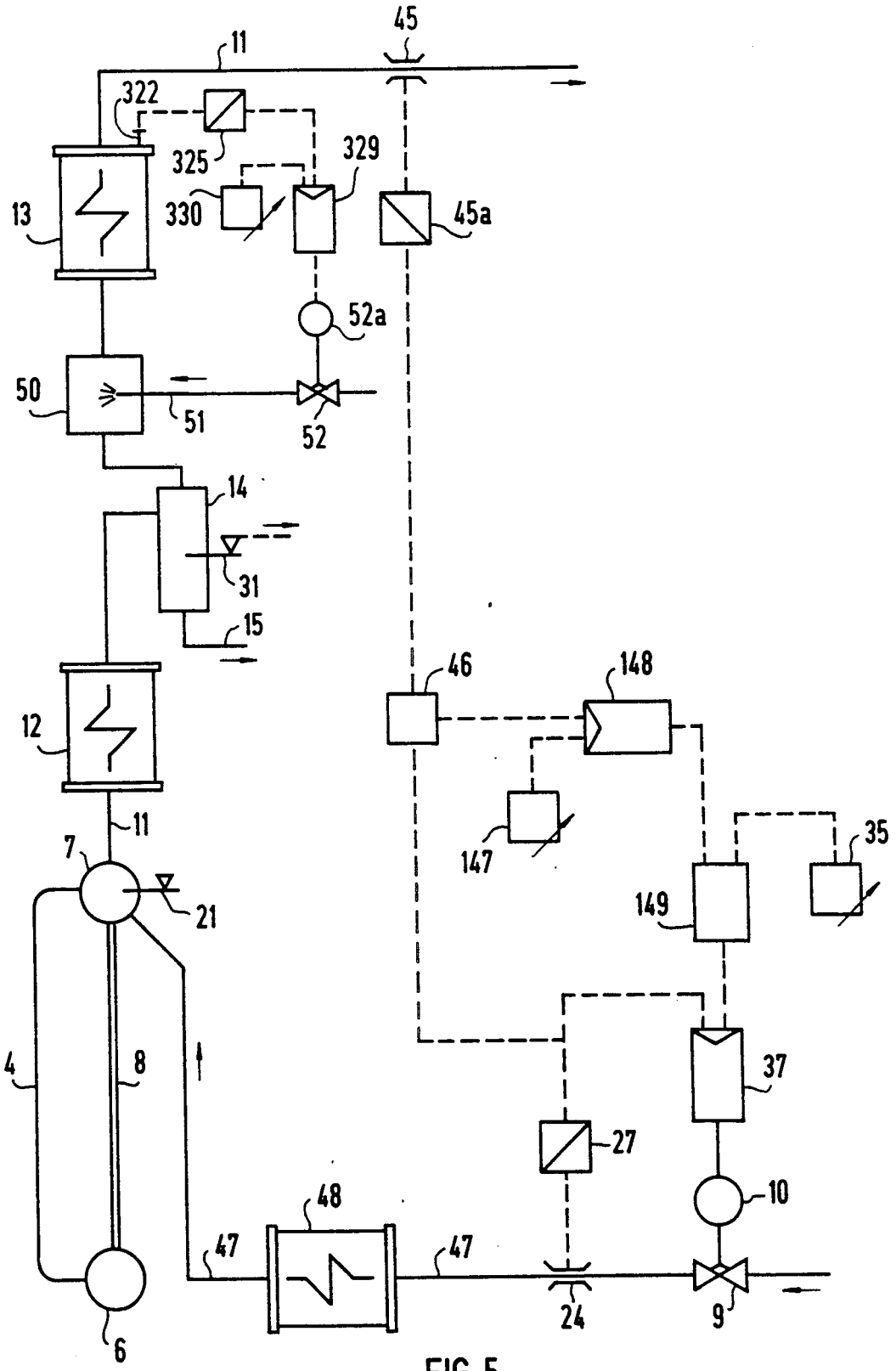

In FIG. 5, identical elements are also identified by the same reference numerals as in FIG. 2. Associated with the water separator 14 is a regulating device that is constructed identically to that of FIG. 2. The steam generator of FIG. 5 differs from that of FIG. 2 substantially due to the fact that instead of the devices 22 and 23 for measuring the steam temperature and steam pressure at the outlet end of the heating surface 12, a steam flow rate meter 45 is installed in the steam line 11, downstream of the heating surface 13. A measuring transducer 45*a* is associated with this steam flow rate meter 45. The output signal of the measuring transducer 45*a* and the output signal of the measuring transducer 27 associated with the feedwater flow rate meter 24 are carried to an apparatus 46 having a computer, for determining the ratio of the flow of feedwater in the feedwater line 47 to the steam flow in the steam line 11, which are measured by the feedwater flow rate meter 24 and the steam flow rate meter 45, respectively. The apparatus 46 for determining the ratio of the feedwater flow in the feedwater line 47 to the steam flow in the steam line 11 furnishes an output signal to a controller 148, which is provided with a set-point adjuster 147.

An injection steam cooler 50 is also connected downstream of the water separator 14 in the steam line 11 and an injection water line 51 is connected to the injection steam cooler 50. A regulating valve 52 with a motor drive 52*a* is located in the injection water line 51. A controller 329, to which a set-point adjuster 330 is assigned, acts upon the motor drive 52*a*. A device 322 (such as a thermocouple) is installed at the outlet end of the heating surface 13 for measuring either the steam temperature at this outlet end or the temperature of the material, which corresponds to this steam temperature at this outlet end. A measuring transducer 325 (signal transducer) that emits an output signal to the controller 329, is assigned to this device 322.

The controller 329 enlarges the flow cross section of the regulating valve 52 whenever a predetermined steam temperature at the outlet end of the heating surface 13 is exceeded, and decreases this cross section whenever the steam temperature drops below this predetermined steam temperature.

The output signal of the controller 148 and the output signal of the set-point adjuster 35 are carried to a maximum value selection unit 149, having an output signal which in turn is carried to the controller 37. As in FIG. 2, the output signal of the measuring transducer 27 assigned to the feedwater flow rate meter 24 is also present at this controller 37.

The mode of operation of the controller 148, the set-point adjuster 147, the maximum value selection unit 149 and the set-point adjuster 35 of FIG. 5 is equivalent to that of the controller 29, set-point adjuster 30, maximum value selection unit 36 and set-point adjuster 35 of the steam generator of FIG. 2.

The flow of feedwater through the feedwater line 47 is always less than the steam flow through the steam line 11, by a predetermined proportion. At a predetermined ratio between the feedwater flow through the feedwater line 47 and the steam flow through the steam line 11, which ratio is less than 1, an adequately large injection water flow through the injection water line 51 for injection into the injection steam cooler 50 can always be available, so that even if there are malfunctions, the steam temperature at the steam outlet of the heating surface 13 can be kept at a constant value.

Figure 6:
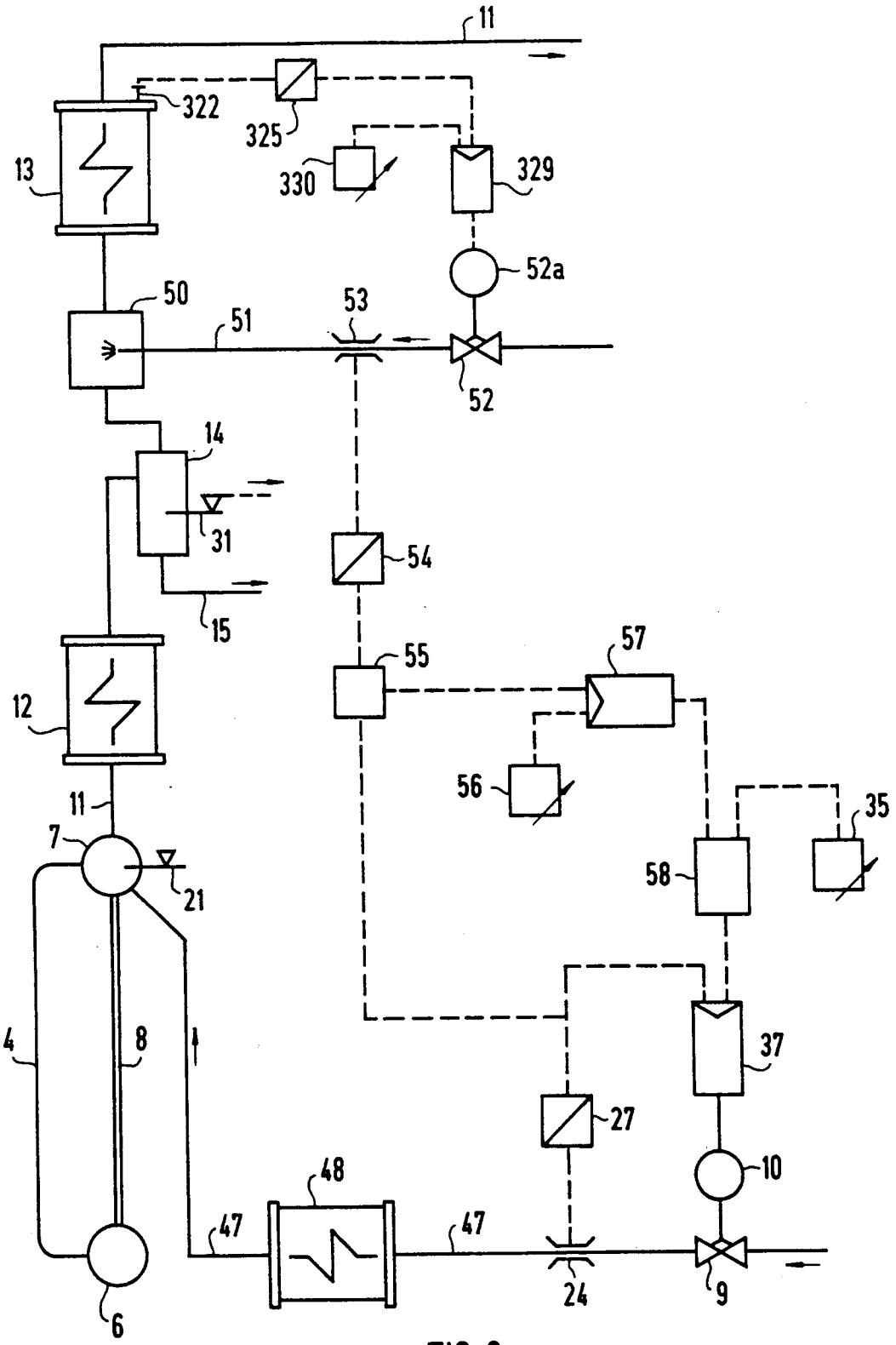

In FIG. 6, identical elements are once again identified by the same reference numerals as in FIG. 2. A regulating device that is constructed identically to that of FIG. 2 is associated with the water separator 14. The steam generator of FIG. 6 differs from that of FIG. 2 especially due to the fact that the devices 22 and 23 for measuring the steam temperature and the steam pressure at the outlet end of the heating surface 12 are omitted. Instead, the injection water line 51 having the regulating valve 52 and the associated motor drive 52*a* and originating at a non-illustrated feedwater pump, is connected to the injection steam cooler 50, which is located in the steam line 11 between the water separator 14 and the heating surface 13, for injecting injection water. The injection water line has an injection water flow rate meter 53 located between the injection steam cooler 50 and the regulating valve 52. The outlet end of the heating surface 13 is provided with the device 322 (a thermocouple), which measures either the steam temperature at this outlet end or the temperature of the material at this outlet end, which corresponds to the steam temperature. The measuring transducer 325 (signal transducer) is associated with this device 322 and emits an output signal to the controller 329 that acts upon the motor drive 52*a*. The controller 329 is provided with the set-point adjuster 330. The controller 329 enlarges the flow cross section of the regulating valve 52 whenever a predetermined constant steam temperature at the outlet end of the heating surface 13 is exceeded, and makes this flow cross section smaller whenever the steam temperature at the outlet end of the heating surface 13 drops below the predetermined constant steam temperature.

The injection water flow rate meter 53 has a measuring transducer 54. An output signal is carried from this measuring transducer 54 to an apparatus 55 having a computer, to which the output signal of the measuring transducer 27 for the feedwater flow rate meter 24 is also carried. The apparatus 55 determines the ratio of the injection water flow into the injection steam cooler 50 through the injection water line 51 to the feedwater flow through the feedwater line 47. An output signal of the apparatus 55 is carried to a controller 57, which is provided with a set-point adjuster 56.

The output signals of the controller 57 and of the set-point adjuster 35 are also carried to a maximum value selection unit 58, having an output signal which is in turn carried to the controller 37. As in FIG. 2, the output signal of the measuring transducer 27 assigned to the feedwater flow rate meter 24 is present at this controller 37.

The mode of operation of the controller 57, the set-point adjuster 56, the maximum value selection unit 58 and the set-point adjuster 35 in the steam generator of FIG. 6, are equivalent to the mode of operation of the controller 29, the set-point adjuster 30, the maximum value selection unit 36 and the set-point adjuster 35 of the steam generator of FIG. 2.

An advantage of the steam generator of FIG. 6 is that at a predetermined ratio, of 0.05 for example, between the injection water flow through the injection water line 51 and the feedwater flow through the feedwater line 47, an adequately large flow of injection water through the injection water line 51 into the injection steam cooler 50 is always available. As a result, the steam temperature at the steam outlet of the reheater surface 13 can be kept at a constant value. No steam flow rate meter is required in the steam line 11, so that downstream of the heating surface this steam line 11 may also include a plurality of partial lines that are parallel to one another.

It is seen from FIG. 7 that the feedwater line 47 having the economizer 48 can also discharge into the down pipes 8. Due to the relatively high density of the feedwater introduced into the down pipes 8, the static water pressure in the down pipes 8 is relatively high. As a result, a relatively high pressure in the inlet header 6 is also attained, so that the natural circulation through the down pipes 8 and the tubes 4 of the tube wall 2 is maintained even where there is a relatively high steam pressure in the tubes 4.

In order to attain a large pressure difference between the inlet header 6 and the outlet header 7 and thus to achieve good natural circulation through the down pipes 8 and the tubes 4 of the tube wall 2, it is advantageous for a feedwater line 47*a* at the point of discharge into the down pipes 8 in the steam generator of FIG. 7, to be constructed as a nozzle 81 of a jet pump 80, as shown in FIG. 8. While the nozzle 81 at the fuel connection of the jet pump 80 is connected through the feedwater line 47 to the economizer 48, each down pipe 8 forms a diffuser 83 of the jet pump 80, with a pressure neck connected between the inlet header 6 and a head 85 of the jet pump 80, and an intake neck 84 connected to the outlet header 7.

A flow of water 86 flowing into the jet pump 80 from the economizer 48 draws a flow of water 87 out of the outlet header 7 by suction. The two water flows 86 and 87 are united in the diffuser 83 into a single water flow 88, which flows at a relatively high pressure into the inlet header 6.

In order to prevent the water emerging from the intake neck 84 from evaporating as a result of a pressure reduction and thereby lessening the effect of the jet pump, the jet pump 80 is suitably disposed locally near the inlet header 7, or some of the flow of water emerging from the economizer 48 is introduced into the down pipe 8 upstream of the intake neck 84. Either of these two provisions effects supercooling of the water flow 87 and thus prevents steam formation in the jet pump 80.

The inside cross section of each down pipe 8 in FIG. 7 is preferably larger than the inside cross section of each of the tubes 4 of the tube wall 2, so that the friction pressure loss in the down pipes 8 is substantially less than in the tubes 4 of the tube wall 2. Due to this provision as well, a reinforcement of the natural circulation through the down pipes 8 and the tubes 4 of the tube wall 2 is attained.

In the steam generator of FIG. 7, each tube 4 of the tube wall 2 that discharges into the outlet header 7 has a shaped segment 96 located in the tube wall 2, by way of which the applicable tube 4 is secured to an additional tube 90 of the tube wall 2. The additional tube 90 is connected to the outlet header 7 through a connecting tube 91. The additional tubes 90 are part of the tube wall 2 and are connected at their upper end to a final header 92. Finally, the steam line 11 and the heating surfaces 12 and 13 originate from the final header 92, which is located on the outside of the vertical gas flue of the steam generator at a higher level than the outlet header 7.

The additional tubes 90 of the tube wall 2 form an additional heating surface. Through the use of this additional heating surface, the natural circulation system determined by the tubes 4 and the down pipes 8 is located near the fossil fuel burners in the openings 99 of the tube wall 2 of FIG. 1. The tubes 4 of the tube wall 2 are heated especially strongly by means of these burners, so that the water in these tubes 4 has a very much lower density than the water in the unheated down pipes 8 on the outside of the gas flue of the steam generator. This favors the natural circulation in the tubes 4 of the tube wall 2 and in the down pipes 8, even if the steam generator is operated at very high pressure, such as supercritical pressure.

The steam generator of FIG. 9, in which identical elements are provided with the same reference numerals as in FIG. 7, has a topping header 93. Connected to this topping header 93 is the feed water line 47 containing the economizer 48. This topping header 93 is at a lower level than the inlet header 6. Extending from the topping header 93 are additional tubes 94, which are part of the tube wall 2 and which form an additional heating surface in this tube wall 2. Each upper end of these additional tubes 94 merges with a tube 4 of the tube wall 2 that is connected to the inlet header 6.

Both the down pipes 8 leading to the inlet header 6 and the tubes 4 of the gas-tight tube wall 2 are connected to the outlet header 7 of the steam generator of FIG. 9. The steam line 11 having the heating surface 12 is also connected directly to the outlet header 7.

The additional heating surface constructed of the additional tubes 94 also has the effect of heating the entire length of the tubes 4 of the tube wall 2 particularly strongly with the fossil fuel burners in the openings 99 of the tube wall 2. As a result, the water in the tubes 4 of the tube wall 2 has a very much lower density than the water in the unheated down pipes 8 on the outside of the gas flue of the steam generator, so that the natural circulation in the tubes 4 of the tube wall 2 and in the down pipes 8 is promoted even if the steam generator is operated at very high pressure, such as supercritical pressure.

The gas-tight tube wall 2 of a steam generator may also have both an additional heating surface with additional tubes 90 leading to a final header 92 as in FIG. 7, and an additional heating surface with additional tubes 94 leading to a topping header 93 as in FIG. 9.

Figure 10:
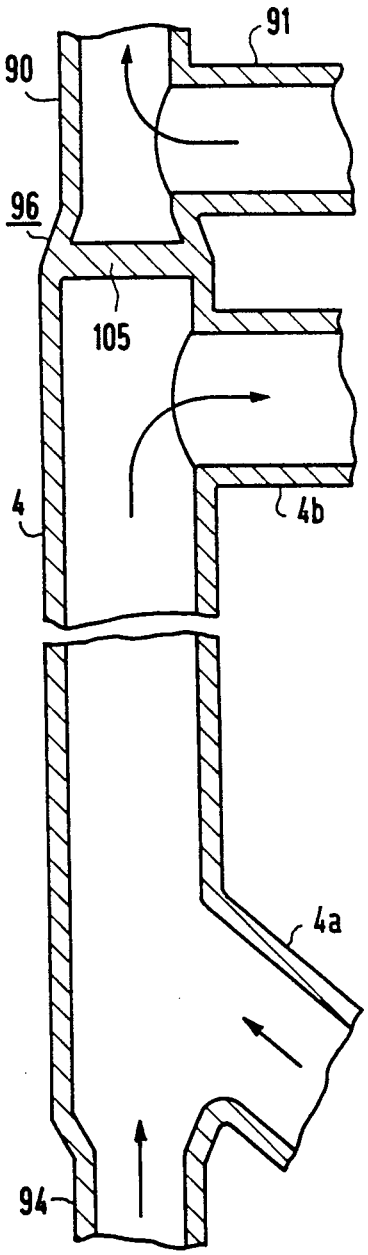

As is shown for this case by the longitudinal section through a tube 4 of the tube wall 2 and through the shaped part 96 in FIG. 10, if ends of the ends 4*a* and 4*b* of the tubes 4 of the tube wall 2 are respectively connected to the inlet header 6 and to the outlet header 7, it is advantageous for the tubes to have an inside cross section which is larger than the tubes 94 originating at the topping header 93 and larger than the additional tubes 90 and the connecting tubes 91 that lead from the outlet header 7 to the final header 92. As a result, particularly low friction pressure loss in the tubes 4 is attained, and the natural circulation in these tubes and in the down pipes 8 is promoted.

Figure 11:
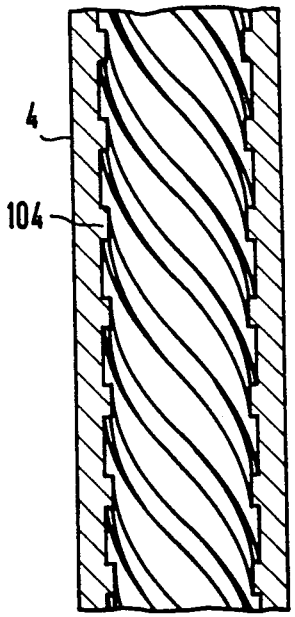

As is shown by the longitudinal section in FIG. 11 which is taken through a tube 4 of FIG. 10, this tube 4 of the tube wall 2 may have helically disposed internal ribs 104. The effect of these internal ribs 104 is that the water component of the water-steam mixture (wet steam) located in the tubes 4 preferentially flows along the inside of the wall of tubes 4, while the steam component flows preferentially in the center of these tubes 4, so that even at low flow density, such as during partial load operation and at subcritical pressure, these tubes 4 will still be well cooled.

Although the shaped element 96, through which the tube 4 of the tube wall 2 is secured to the additional tube 90 of this tube wall, tightly seals off the tube 4 from the additional tube 90 through a partition 105 in FIG. 10, it is also advantageous and possible, as shown in the longitudinal section of FIG. 12, for this shaped element 96 in the partition 105 to form a flow opening 97 from the tube 4 to the additional tube 90, having a flow cross section which is smaller than the inside cross section of the tube 4. This flow opening 97 reduces the flow through the outlet header 7 and also thus reduces the pressure loss in this outlet header 7, and thus promotes the natural circulation in the tubes 4 and down pipes 8.

A collar 98 formed on the side of the tube 4 of the tube wall 2 at the flow opening 97 in the partition 105 and surrounding the flow opening 97 can prevent water components of the wet steam in the tubes 4 from passing through the flow opening 97 and into the additional tube 90.

As the cross section through the outlet header 7 of FIG. 13 shows, the tubes 4 of the tube wall 2 discharge at a tangent into the hollow cylindrical wall of the outlet header 7, and the additional tubes 90 of the tube wall 2 extend radially outward from this wall. The water/steam mixture entering the outlet header 7 through the tubes 4 is thus given a spin, which leads to a separation of water and steam in the outlet header 7, particularly at partial-load operation of the steam generator at subcritical pressure. Due to the fact that the additional tube 90 leads radially outward, the entrainment of water separated in these additional tubes 90 in the outlet header is largely avoided, preferentially at the upper end of the outlet header. The down pipes 8 likewise extend radially outward from the hollow cylindrical wall of the outlet header 7.

In FIG. 14, identical elements are also provided with the same reference numerals as in FIG. 2. A regulating device that is constructed identically to that of FIG. 2 is associated with the water separator 14. The steam generator of FIG. 14 differs from that of FIG. 2 substantially due to the fact that instead of the devices 22 and 23 for measuring the steam temperature or the steam pressure at the outlet end of the heating surface 12 in the steam line 11, in FIG. 14 there is a Venturi tube 209 between the outlet header 7 and the heating surface 12, having a Venturi restriction 210 of the cross section of the inside of the tube, as the longitudinal section of FIG. 15 shows. In the Venturi tube 209, two electrodes 211*a* and 211*b* of an electric capacitor are mounted on the Venturi restriction 210. The electrodes 211*a* and 211*b* are provided with a coating of an electrically insulating material, and the interior of the Venturi tube 209 at the Venturi restriction 210 is located between them. Connected to the electrodes 211*a* and 211*b* is a measuring transducer 211*c*, which emits an output signal corresponding to the capacitance of the capacitor.

As is also shown by the longitudinal section of FIG. 15, a device 212 (such as a thermocouple) which is used for measuring the steam temperature and to which a measuring transducer 212*c* is assigned, is located immediately upstream of the Venturi restriction 210 in the tube of the steam line 11.

A pressure measuring tube 213 begins from a point of minimum inside tubular cross section of the Venturi restriction 210 and a pressure measuring tube 214 begins from the Venturi tube 209 in the line 11 at a point of maximum inside tubular cross section upstream of the Venturi restriction 210, as seen in the flow direction of the steam line 11. The pressure measuring tubes 213 and 214 lead to a differential pressure meter 215 (such as a spring differential pressure meter) which is connected to a measuring transducer 213*c* that emits an output signal which corresponds to the difference in the steam pressures at the points of maximum and minimum internal tubular cross section. The pressure measuring tube 214 also leads to a pressure meter 216 (such as a spring pressure meter) which is connected to a measuring transducer 214*c* that emits an output signal which is equivalent to the steam pressure at the point of maximum internal tubular cross section (compare U.S. Pat. No. 4,829,831).

The measuring transducers 211*c*, 212*c*, 213*c* and 214*c* each emit their output signal to a device 240 for determining the residual moisture in the steam flowing in the steam line 11

This device 240 emits its output signal, which is equivalent to the residual moisture of the steam in the steam line 11 of FIG. 14, to a controller 241 which is provided with a set-point adjuster 242.

The output signal of the controller 241 and the output signal of a set-point adjuster 35 are carried to a maximum value selection unit 243, having an output signal which is present at the controller 37. Also present at the controller 37 is the output signal of the measuring transducer 27 assigned to the feedwater flow rate meter 24.

The mode of operation of the controller 241, the set-point adjuster 242, the maximum value selection unit 243 and the set-point adjuster 35 is equivalent to the mode of operation of the controller 29, the set-point adjuster 30, the maximum value selection unit 36 and the set-point adjuster 35 of the steam generator of FIG. 2.

An advantage of the steam generator according to FIG. 14 is that the regulating device for varying the supply of feedwater can react very quickly to changes in the thermal output that is transmitted to the water evaporating in the tubes 4 of the tube wall 2 and of the tube bottom 3, since the measurement variables for determining the residual moisture of the steam in the steam line 11 are picked up directly downstream of the gas flue at the tube wall 2, at which the fossil fuel burners are located in the openings 99.

The residual moisture of the steam in the steam line 11 is suitable as a controlled variable only as long as the pressure in the steam generator of FIG. 14 is below the critical pressure. Once the critical pressure is reached, the device 240 for determining the residual moisture of the steam, which emits an output signal corresponding to the residual moisture of the steam in the steam line 11, should be shut off, and one of the regulating devices as shown in FIGS. 2, 3, 5 or 6 should be switched on.

We claim:

1. A steam generator, comprising:

a gas flue having burners for fossil fuel, a gas-tight tube wall with tubes, an inlet header and an outlet header connected to said tubes, said outlet header being at a higher local level than said inlet header, and a down pipe outside said tube wall connecting said outlet header to said inlet header, so as to permit flowing of a fluid between said outlet header and said inlet header;

a steam line connected to said outlet header, at least one heating surface connected downstream of said outlet header in said steam line, so as to permit flowing of a fluid from said outlet header to said heating surface;

a feedwater line connected to said gas flue, an economizer connected upstream of said gas flue in said feedwater line, so as to permit flowing of a fluid from said economizer to said gas flue;

and a regulating device for influencing feedwater flow in said feedwater line, said regulating device detecting at least one of the following controlled variables:

(a) steam enthalpy in one of said heating surface and said steam line downstream of said heating surface, (b) steam temperature in one of said heating surface and said steam line downstream of said heating surface, (c) thermal output transfer to one of said tubes of said gas-tight tube wall, (d) a ratio of feedwater flow in said feedwater line to steam flow in said steam line, (e) a ratio of injection water flow into an injection cooler connected in the steam line to feedwater flow in said feedwater line, and (f) residual moisture of steam in said steam line.

2. The steam generator according to claim 1, wherein said feedwater line is connected to said outlet header.

3. The steam generator according to claim 1, wherein said feedwater line is connected to said down pipe.

4. The steam generator according to claim 1, including a topping header disposed at a lower local level than said inlet header, said feedwater line being connected to said topping header, said gas-tight tube wall having additional tubes extending from said topping header, each of said additional tubes merging with a respective one of said tubes of said gas-tight tube wall being connected to said inlet header.

5. The steam generator according to claim 1, wherein said regulating device detects the variable c and at least one of the variables a, b, d, e and f as controlled variables.

6. The steam generator according to claim 3, including a jet pump, said feedwater line having a point of discharge into said down pipe in the form of a nozzle of said jet pump, said nozzle having a fuel connection connected to said economizer, said down pipe forming a diffuser of said jet pump at said point of discharge with a pressure neck connected to said header, and said jet pump having a head with an intake neck connected to said outlet header.

7. The steam generator according to claim 1, wherein the inside cross section of said down pipe is larger than the inside cross section of each of said tubes of said gas-tight tube wall.

8. The steam generator according to claim 1, wherein said tubes of said gas-tight tube wall have helically disposed internal ribs.

9. The steam generator according to claim 1, including a final header disposed at a higher level than said outlet header, and additional tubes of said tube wall being connected to said outlet header and leading to said final header.

10. The steam generator according to claim 9, wherein said tubes of said gas-tight tube wall have a larger inside cross section than said additional tubes leading from said outlet header to said final header.

11. The steam generator according to claim 4, wherein said tubes of said gas-tight tube wall have a larger inside cross section than said additional tubes originating at said topping header.

12. The steam generator according to claim 9, including a shaped element disposed in said gas-tight tube wall for securing one of said tubes of said gas-tight tube wall discharging into said outlet header to one of said additional tubes.

13. The steam generator according to claim 12, wherein said shaped element has a flow opening formed therein from said one tube to said one additional tube of said gas-tight tube wall, said flow opening having a smaller flow cross section than the inside cross section of said one tube.

14. The steam generator according to claim 1, wherein said outlet header has a hollow cylindrical wall into which one of said tubes of said gas-tight tube wall discharges at least approximately at a tangent.

15. The steam generator according to claim 9, wherein said outlet header has a hollow cylindrical wall from which one of said additional tubes of said gas-tight tube wall extends radially outwardly.

16. The steam generator according to claim 9, wherein said outlet header has a hollow cylindrical wall into which one of said tubes of said gas-tight tube wall discharges at least approximately at a tangent and from which one of said additional tubes of said gas-tight tube wall extends radially outwardly.

17. The steam generator according to claim 1, including a water separator connected downstream of said at least one heating surface for separating water.

18. The steam generator according to claim 1, including at least one of superimposed and separating controls acting on a flow of feedwater in said feedwater line.

19. The steam generator according to claim 1, including a controller acting on a flow of feedwater in said feedwater line, and a superimposed controller feeding an output to said controller as a set-point value, one of said controlled variables a–f being supplied to said superimposed controller as an actual value.

* * * * *